US007682765B2

(12) United States Patent
Sugawa et al.

(10) Patent No.: US 7,682,765 B2
(45) Date of Patent: Mar. 23, 2010

(54) TONER FOR DEVELOPING ELECTROSTATIC IMAGES

(75) Inventors: Etsuko Sugawa, Atsugi (JP); Chieko Mihara, Isehara (JP); Takashi Kenmoku, Fujisawa (JP); Tatsuki Fukui, Yokohama (JP); Shinya Kozaki, Tokyo (JP); Tsutomu Honma, Tokyo (JP); Tetsuya Yano, Atsugi (JP); Shigeki Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 675 days.

(21) Appl. No.: 11/298,540

(22) Filed: Dec. 12, 2005

(65) Prior Publication Data

US 2006/0127786 A1 Jun. 15, 2006

(30) Foreign Application Priority Data

Dec. 10, 2004 (JP) ..... 2004-358390

(51) Int. Cl.
*G03G 9/08* (2006.01)

(52) U.S. Cl. ..... 430/111.4; 430/108.1; 430/110.1; 430/122.5

(58) Field of Classification Search ..... 430/108.1, 430/110.1, 111.4, 122.5
See application file for complete search history.

(56) References Cited

U.S. PATENT DOCUMENTS 6,777,153 B2 8/2004 Yano et al. ..... 430/110
6,908,721 B2 6/2005 Kenmoku et al. ..... 430/108.5
6,911,520 B2 6/2005 Fukui et al. ..... 528/272
7,045,321 B2 5/2006 Imamura et al. ..... 435/128
2005/0250191 A1 11/2005 Imamura et al. ..... 435/135
2005/0260514 A1 11/2005 Mihara et al. ..... 430/108.4
2006/0014921 A1 1/2006 Mihara et al. ..... 528/272
2006/0287473 A1 12/2006 Fukui et al. ..... 528/272

FOREIGN PATENT DOCUMENTS

WO WO 2004/061530 A1 * 7/2004

OTHER PUBLICATIONS

Patent Abstract of Japan for JPLO 57-045555 (1982).
Patent Abstract of Japan for JPLO 57-064250 (1982).
Patent Abstract of Japan for JPLO 02-167567 (1990).
Patent Abstract of Japan for JPLO 07-209908 (1995).
Patent Abstract of Japan for JPLO 09-204073 (1997).
Patent Abstract of Japan for JPLO 11-282212 (1999).

* cited by examiner

*Primary Examiner*—Mark F Huff
*Assistant Examiner*—Peter L Vajda
(74) *Attorney, Agent, or Firm*—Fitzpatrick, Cella, Harper & Scinto

(57) ABSTRACT

To provide a toner for developing electrostatic images which is not easily cause the phenomenon of toner-spent, constituent materials are so selected that a charge control resin has hardness which is the same as the hardness of a binder resin or the charge control resin is harder than the binder resin, as measured with a scanning probe microscope in a viscoelasticity evaluation mode in respect to the binder resin and the charge control resin which are present in the particle interiors or particle surfaces of the toner.

7 Claims, 2 Drawing Sheets

TONER FOR DEVELOPING ELECTROSTATIC IMAGES

BACKGROUND OF THE INVENTION

1. Field of the Invention

This invention relates to a toner for developing electrostatic images. More particularly, this invention also relates to a toner for developing electrostatic images which comprises a binder resin incorporated with a colorant and a charge control resin.

2. Related Background Art

Toners used to develop electrostatic latent images are required to have a proper charge quantity in order to obtain sharp images with less fog. The toners are further required to undergo less changes with time in charge quantity, and do not cause any changes such as serious attenuation of charge quantity and agglomeration because of environmental changes (e.g., changes in temperature and humidity). The reason therefor is as follows:

That is, with a decrease in charge quantity because of its attenuation from the value set originally, the toner may more come to scatter, and hence there is a possibility of causing problems such that the fog occurs to blacken background areas which should normally be left white and that the developing unit is contaminated at its surrounds by the toner.

In order to achieve proper charge quantity, usually, charge control agents are added to toners. Nigrosine dyes, metal-containing azo dyes and so forth have hitherto been in wide use as charge control agents for providing the toners with positive electric charges; and compounds of metals containing a heavy metal, as charge control agents for providing the toners with negative electric charges. However, as regards these charge control agents, it is pointed out that they must further be improved in environmental properties and safety.

Meanwhile, a technique is also known in which a charge control resin is added to the toner (Japanese Patent Application Laid-open No. H02-167565). However, a phenomenon may take place in which a negative charge control resin coming present at toner particle surfaces adheres to charge-providing members (a phenomenon called "toner-spent"). Hence, there is a possibility that the charge-providing members come to have a low charge-providing ability as a result of long-term service.

SUMMARY OF THE INVENTION

Accordingly, the present inventors have made studies on a toner which can make the toner-spent less occur. With repetition of such studies, it has come to turn out that this phenomenon called the toner-spent is deeply concerned with the softening point or glass transition temperature of a charge control resin, which is a polymer.

In other words, the phenomenon of toner-spent is concerned with the hardness of a charge control resin, and this means that the information about the softening point or glass transition temperature of a charge control resin is important in order to make up the desired toner.

However, in the strict sense, the charge control resin differs in glass transition temperature, which is one of physical properties, between its interior and its surface. This is because the surface or interface of a polymeric solid such as the charge control resin is in contact with a heterogeneous phase and hence the polymeric solid is in the state of energy that is very different between its interior and its surface side. As regards the molecular-weight distribution that is characteristic of polymeric-solid materials, too, the polymeric solid may greatly differ in it between the interior and the surface, in the form of surface segregation of a low-molecular weight component.

Thus, it may be difficult to design and produce a toner having the desired properties, by merely using the information about the glass transition temperature or softening point.

The present inventors have become aware that a method is necessary by which the information about the physical properties of the charge control resin present at the toner particle surfaces can directly be acquired. Under such a background, the present inventors have discovered that the correlation in hardness between the charge control resin and the binder resin which are present at the toner particle surfaces can be caught by using a scanning probe microscope.

An object of the present invention is to provide a toner for developing an electrostatic image which toner is specified using a scanning probe microscope, in regard to the charge control resin present at the toner particle surfaces, and to provide an image forming method making use of such a toner.

Incidentally, the glass transition temperature refers to the temperature at which the "glass transition" takes place which is a phenomenon that a polymeric substance changes from a glassy hard state to a rubbery state when heated. Also, when a bituminous material (a compound composed of hydrocarbon) is heated, it gradually becomes soft with an increase in temperature, until it becomes liquid to come to flow out. The temperature at which it becomes liquid in this way is referred to as the softening point.

The toner for developing an electrostatic image comprises:

a colorant;

a binder resin; and a charge control resin; and is characterized in that;

the charge control resin has hardness which is the same as the hardness of the binder resin or the charge control resin is harder than the binder resin, as measured with a scanning probe microscope in a viscoelasticity evaluation mode in respect to the binder resin and the charge control resin which are present in the particle interiors or particle surfaces of the toner.

Here, the toner is characterized by having, e.g., a structure in which, at or in its particle surfaces or interiors, the charge control resin distributes in island-shaped domains in respect to the binder resin.

The measurement in a viscoelasticity evaluation mode may be made at a temperature of 70° C. or less.

The charge control resin may also preferably have a melting point or a glass transition point within the range of from 20° C. to 150° C.

The image forming method of the present invention is characterized by:

forming on an image bearing member an electrostatic image corresponding to image information;

developing the electrostatic image by the use of the above toner for developing an electrostatic image, to form a developer image;

transferring the developer image to a transfer member;

transferring to a sheetlike transfer medium the developer image transferred to the transfer member; and thereafter fixing the developer image to the transfer medium.

According to the above present invention, it can provide a toner for developing electrostatic images which toner can not easily cause the toner-spent.

Figure 1:
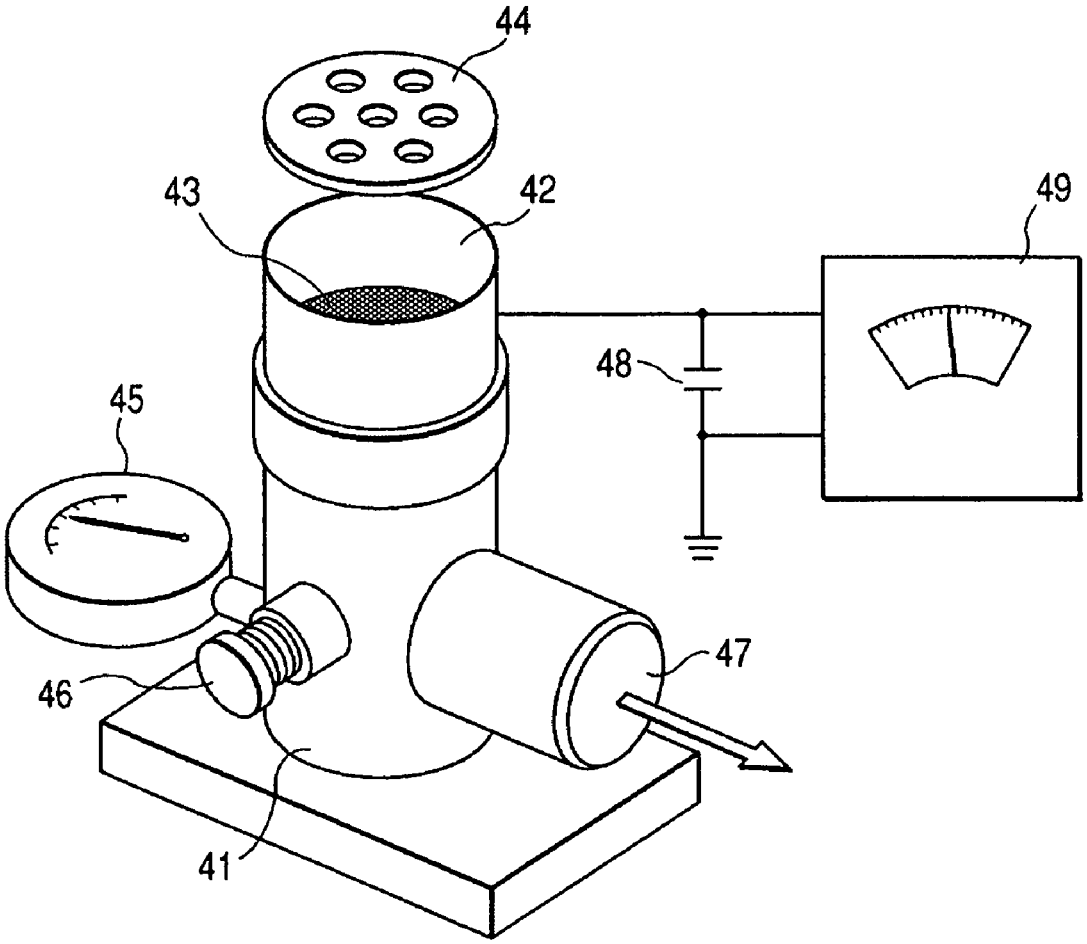
FIG. 1 is a diagrammatic view showing a blow-off charge quantity measuring instrument with which the charge quantity of toner is measured.

Incidentally, in the drawing, reference numeral 43 denotes a screen; 45, a vacuum indicator; 47, a suction opening; and 49, a potentiometer.

Figure 2:
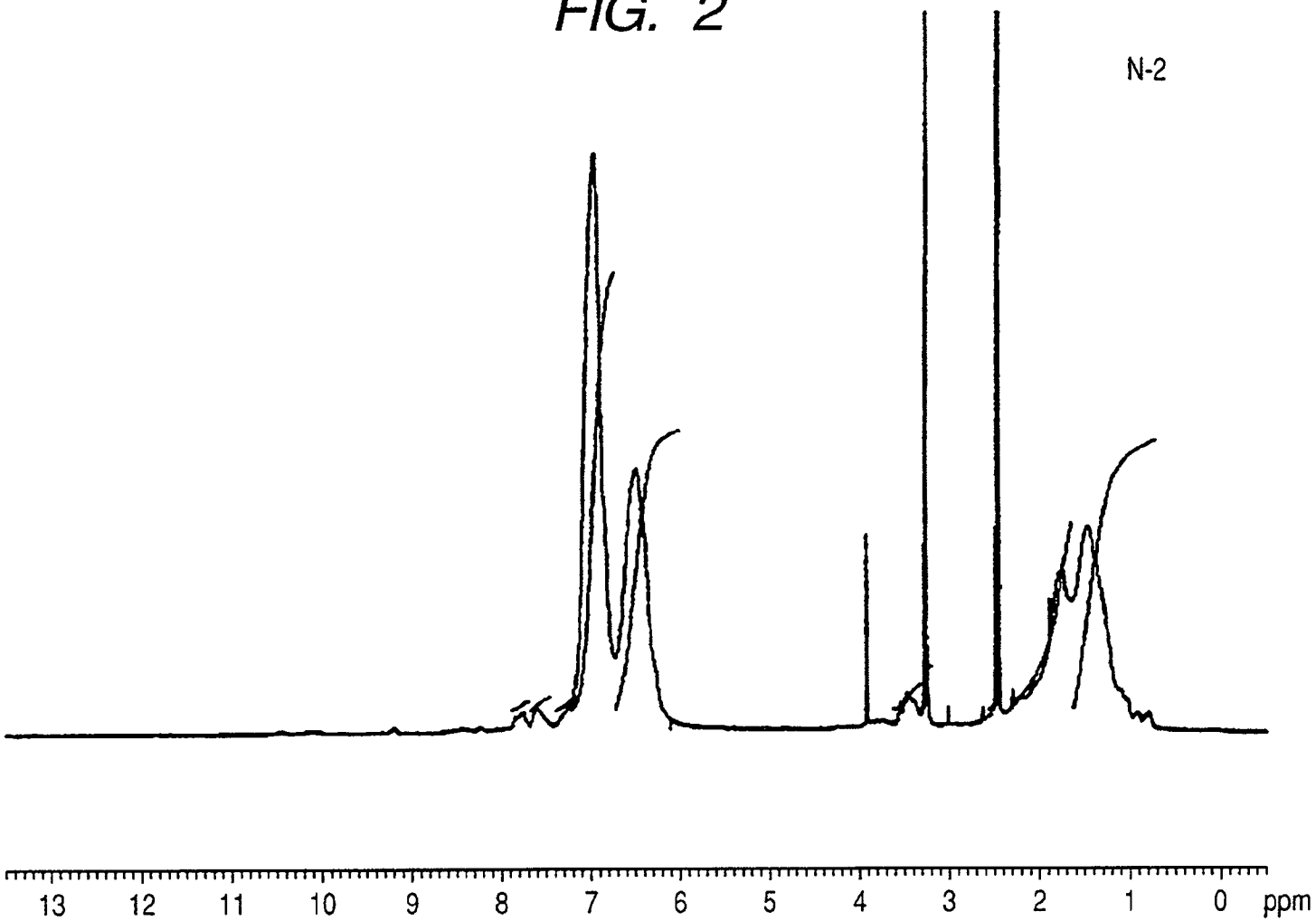

FIG. 2 shows a $^{1}$H-NMR chart of the polymer produced in Example N-2, having a unit represented by the formula N-2.

DESCRIPTION OF THE PREFERRED EMBODIMENTS

The present inventors have found that the phenomenon called the toner-spent and a lowering of the charging ability of charge providing members are greatly concerned with the physical properties, in particular, viscoelasticities of the binder resin and charge control resin in toner particles, and have made extensive studies thereon.

Then, they have found that, as long as the charge control resin is harder than the binder resin, constituting the toner, (or the both have equal hardness,) the toner-spent may less occur which is caused when the charge control resin having come to the toner particle surfaces is selectively scraped off during long-term running. If on the other hand the charge control resin present at the toner particle surfaces is softer than the surrounding binder resin, the toner-spent tends to occur. Accordingly, the softening point or glass transition temperature of the charge control resin makes one of the important material choices.

However, the hardness of the polymer surface can not precisely be known from the value of dynamic viscoelasticity, the glass transition temperature, the softening point and so forth which have hitherto been used, like those measured in bulk samples. This is because polymers are formed from chemical structures having different cohesive densities, such as backbone chains, side chains and molecular-chain terminals, or polymer chains come pseudo-equilibrated in the shape of random coils in bulk solids, and hence their physical properties differ between surfaces or interfaces and bulk phases.

The present inventors have taken note of a viscoelasticity evaluation method making use of a scanning probe microscope. They have found that the relationship between the hardness of the binder resin and that of the charge control resin at the toner particle surfaces can be evaluated by examining the amplitude of probe vibration in a viscoelasticity evaluating mode of the microscope, or the phase changes of probe vibration in a tapping mode thereof. Incidentally, in some cases, the viscoelasticity evaluation mode is called a force modulation mode.

The method of evaluating the toner by using the viscoelasticity evaluation mode of the scanning probe microscope enables substitution of part of the conventional, complicate and time-consuming operation for evaluating the running performance of toners for developing electrostatic images, and hence enables highly efficient product advancement of the toners for developing electrostatic images.

(Viscoelasticity Evaluation by Scanning Probe Microscope)

The use of the scanning probe microscope enables detection of various mutual actions between the tip of a probe and the surface of a sample on the sample surface.

In the force modulation mode for evaluating the viscoelasticity, the probe is pressed against the sample to make measurement. At the time of the measurement, the probe vibrates at a stated amplitude. Then, the information about the vibration of the probe is gained by utilizing the variations of reflected light (variations of reflection angles) of laser light with which the probe is irradiated.

In the case of a hard sample, the tip of the probe can not easily creep into the interior of the sample, and hence the probe is forced up at the sample surface. As the result, the vibration of the probe is outputted as the force of response with a large amplitude. On the other hand, in the case of a soft sample, the tip of the probe creeps into it, and hence the probe does not so much deform, resulting in a small amplitude of the force of response.

In the tapping mode, in which the tip of the probe is vibrated in the state it is brought into light touch with the sample, no delay of phases comes about between applied signals and response signals by the Hooke law as long as the sample is a perfect elastic body. On the other hand, where the sample is an elastic body, a delay of phases comes about between applied signals and response signals.

The size of amplitude in the force modulation mode for evaluating the viscoelasticity and the changes in phases in the tapping mode may be measured, whereby the viscoelasticity at the ultimate surface of a polymer can be known.

In the present invention, the above methods are used to evaluate the viscoelasticity of the binder resin and that of the charge control resin. Then, in the choice of combination of a binder resin with a charge control resin which form a toner for developing electrostatic images, such evaluation enables selection of the charge control resin which is harder than, or has substantially the same hardness as, the binder resin.

In the present invention, the measurement is made in the viscoelasticity evaluation mode of the scanning probe microscope, in respect of a melt-kneaded product of the binder resin and the charge control resin, or the surfaces or sections of particles obtained by pulverizing the melt-kneaded product and classifying the pulverized product. Of course, toners made up by other methods can also be evaluated. Then, toner particles are used which have a structure in which the charge control resin distributes in the binder resin in island-shaped domains relatively having the same hardness as, or a higher hardness than, the binder resin, at least within the temperature range of 70° C. or less.

As the probe used in the measurement, various types are usable. The probe material, spring constant, length, resonant frequency and so forth may appropriately be selected according to the hardness, quality and so forth of the materials for measurement. In order to accurately compare the hardness of the binder resin with that of the charge control resin, it is preferable to make the measurement by using a probe (length: 225 μm; frequency: 10 to 100 kHz) made of single-crystal silicon, for use in the viscoelasticity evaluation mode and having a spring constant of 0.1 to 10.0 N/m.

Where the amplitude of probe vibration in the grain region in which the charge control resin is present is larger than that in the binder resin region in the measurement in the viscoelasticity evaluation mode (force modulation mode) (first condition), it can be said that the charge control resin is harder than the binder resin at the sample surfaces. Also, where the difference of phases of probe vibration in the same region is smaller than that in the binder resin region in the measurement in the tapping mode (second condition), it can be said that the charge control resin is harder than the binder resin at the sample surfaces.

In the present invention, the toner is so constituted as to satisfy at least the above first condition. More preferably, the toner is so constituted as to satisfy the above two conditions.

Incidentally, where the toner satisfies the above first condition, the difference of phases of probe vibration in the same region may come larger than that in the binder resin region when measured in the tapping mode. This is assumed to be a case in which, although the charge control resin domains themselves are hard, viscous substances or water stand(s) adherent thereto.

From the viewpoint of environmental resistance and running performance, it is further preferable that the comparison of the surface hardness of the charge control resin with that of the binder resin by the use of the scanning probe microscope is made at 100° C. or less, and may more preferably be made in the temperature range of at least 70° C. and a temperature lower than that.

Respective constituents of the toner of the present invention are detailed below.

Charge Control Resin

As the charge control resin used in the present invention, any of known ones may be used which are conventionally used in dry-process development. Stated specifically, it may include resins such as styrene-acrylic resins, styrene resins and acrylic resins into which functional groups have been introduced.

As the charge control resin, two types are available which are used for positive charge control and negative charge control in accordance with charge characteristics of the toner. Into the charge control resin for positive charge control, a basic nitrogen atom as exemplified by a quaternary ammonium salt may be introduced as the functional group. On the other hand, into the charge control resin for negative charge control, a group as exemplified by a carboxyl group or a sulfo group may be introduced as the functional group. Incidentally, the functional group may be introduced in a state as it stands, but may preferably be in a state of a salt such as a hydrochloride or a sulfate.

The charge control resin used in the present invention may preferably have a melting point of from 20 to 150° C., and particularly from 40 to 150° C., or, though having no melting point, may preferably have a glass transition point of from 20 to 150° C., and particularly from 40 to 150° C. If it has a melting point of less than 20° C., or has no melting point and has a glass transition point of less than 20° C., it may adversely affect the fluidity or storage stability of toner. If on the other hand it has a melting point of more than 150° C., or has no melting point and has a glass transition point of more than 150° C., the charge control resin may be kneaded in toner materials with difficulty, tending to result in a broad charge quantity distribution.

The melting point Tm and the glass transition point Tg in this case may be measured with, e.g., a differential scanning calorimeter of a highly precise, inner-heat input compensation type, such as DSC-7, manufactured by Perkin Elmer Co.

Binder Resin

As the binder resin, any of those usually used when toners are produced may be used without any particular limitations. For example, the binder resin may include styrene type polymers, polyester type polymers, epoxy type polymers, polyolefin type polymers and polyurethane type polymers, any of which may be used alone or in the form of a mixture.

The styrene type polymers may include copolymers of styrene with acrylate or methacrylate; and copolymers of styrene with diene monomers (such as butadiene and isoprene), and copolymers of other monomers copolymerizable with these.

The polyester type polymers may include polycondensation products of aromatic dicarboxylic acids with alkylene oxide addition products of aromatic diols.

The epoxy type polymers may include reaction products of aromatic diols with epichlorohydrin, and modified products thereof.

The polyolefin type polymers may include polyethylene, polypropylene, and copolymers of any of these with other copolymerizable monomers.

The polyurethane type polymers may include polyaddition products of aromatic diisocyanates with alkylene oxide addition products of aromatic diols.

The binder resin used in the present invention is by no means limited to the above.

(Cross-linking Agent)

When the binder resin used in the present invention is made up, a cross-linking agent as shown below may optionally be used. For example, it may include, e.g., as bifunctional cross-linking agents, divinylbenzene and bis(4-acryloxypolyethoxyphenyl)propane. As trifunctional or higher polyfunctional cross-linking agents, it may include, e.g., pentaerythritol triacrylate and trimethylolethane triacrylate.

(Polymerization Initiator)

When the binder resin used in the present invention is made up, a polymerization initiator as shown below may also optionally be used. For example, it may include di-t-butyl peroxy-2-ethylhexanoate and cumin perpivalate.

Any of these may be used alone or in combination. The initiator may be used in a concentration of 0.05 part by mass or more, and preferably from 0.1 part by mass to 15 parts by mass, based on 100 parts by mass of the monomer.

(Biodegradable Plastic)

In the present invention, a biodegradable plastic may further be used.

In the combination of the above binder resin with the charge control agent, the polymer structure of the binder resin and the polymer structure of the polymer chain of the charge control agent may preferably be similar to each other as far as possible. If the polymer structure of the binder resin and the polymer structure of the polymer chain of the charge control agent are greatly different from each other, the charge control agent tends to be insufficiently dispersed in the binder resin.

As methods by which the charge control resin is incorporated into toner particles, available are a method in which it is internally added to the toner particles and a method in which it is externally added to the toner particles.

Where the charge control resin is internally added to the binder resin, it may usually be added in a mass proportion of from 0.1 to 50% by mass, preferably from 0.3 to 30% by mass, and more preferably from 0.5 to 20% by mass, based on the mass of the binder resin. Here, if the mass proportion of the charge control resin internally added is less than 0.1% by mass, a low charge quantity may result. If it is more than 50% by mass, the toner may have a poor charging stability.

It is preferable that at least part of the charge control resin dispersed in the binder resin forms discontinuous domains. Compared with a case in which the former completely dissolves in the latter, the charge control resin added tends to come uncovered to toner particle surfaces, so that it can exhibit the intended effect in its addition in a small quantity. The domains may also preferably be dispersed in a particle diameter of from 0.01 to 4 μm, and more preferably from 0.05 to 2 μm. If they are dispersed in a particle diameter of more than 4 μm, they may stand dispersed poorly, resulting in a broad charge quantity distribution and also causing problems that the toner may have low environmental properties and running performance and that the toner may have a poor transparency. If on the other hand they are dispersed in a particle diameter of less than 0.01 μm, they stand like the case in which the charge control resin completely dissolves in the binder resin without forming any discontinuous domains, making it necessary to add the charge control resin in a large quantity.

Whether or not at least part of the charge control resin forms discontinuous domains and what dispersion particle diameter it has can be ascertained by observation with the scanning probe microscope or by observing slices of toner particles on a transmission electron microscope or the like. To observe interfaces clearly, it is also effective to dye the slices of toner particles with ruthenium tetraoxide or osmium tetraoxide and thereafter observe them on the electron microscope.

Where the charge control resin is externally added to the binder resin, it may preferably be added in a mass proportion of from 0.01 to 5% by mass based on the mass of the binder resin. In particular, it may preferably be made to adhere mechanochemically to toner particle surfaces.

In the present invention, in respect of the charge control resin and the binder resin which have been selected taking account of fundamental physical properties of binder resins and charge control resins and compatibility between them as stated above, their viscoelasticity is evaluated using the scanning probe microscope. Then, a preferable combination of the charge control resin with the binder resin is determined.

After this combination has been determined, a colorant and other various additives as described below may be added to make up the toner for developing electrostatic images according to the present invention.

Other Constituent Materials

The toner for developing electrostatic latent images according to the present invention may have a compositional proportion that usually the charge control resin is in an amount of from 0.1 to 50% by mass, the binder resin from 20 to 95% by mass, and a coloring material from 0 to 15% by mass, on the basis of toner mass.

The toner may optionally contain a magnetic powder (such as a powder of a ferromagnetic metal such as iron, cobalt or nickel or a compound such as magnetite, hematite or ferrite) in an amount of 60% by mass or less.

It may further be incorporated with various additives such as a lubricant (e.g., polytetrafluoroethylene, a low-molecular weight polyolefin, a fatty acid, or a metal salt or amide thereof), and other charge control agent (e.g., a metal-containing azo dye or a salicylic acid metal salt). In order to improve the fluidity of toner, a fine hydrophobic colloidal silica powder or the like may also be used. Any of these additives may usually be added in an amount of 10% by mass or less on the basis of toner mass.

The following compound may further be incorporated in the binder resin as long as it does not adversely affect the effect in the present invention (in a proportion smaller than the content of the binder resin component)

It is, e.g., a silicone resin or the like.

(Colorant)

As the colorant that constitutes the toner for developing electrostatic latent images according to the present invention, any colorants may be used as long as they are those usually used when toners are produced. For example, carbon black, titanium white and any other all pigments and/or dyes may be used. Any of these colorants may usually be used in a proportion of approximately from 0.1 to 60 parts by mass, and preferably from 0.5 to 20 parts by mass, based on 100 parts by mass of the binder resin.

(Silica External Additive)

In the present invention, to the toner produced by the process as described above, it is preferable to add a fine silica powder in order to improve charging stability, fluidity and running performance. As the fine silica powder used here, a fine silica powder gives good results which has a specific surface area of 20 $m^2/g$ or more, and particularly in the range of from 30 to 400 $m^2/g$, as measured by nitrogen adsorption according to the BET method. In this case, the fine silica powder may be used in an amount of from 0.01 to 8 parts by mass, and preferably from 0.1 to 5 parts by mass, based on 100 parts by mass of the toner particles.

(Inorganic Powder)

In order to improve toner's developing performance and running performance, it is also preferable to add the following inorganic powder. It may include, e.g., magnesium powder and zinc powder.

(Lubricant)

A lubricant powder as shown below may also be added to the toner. It may include, e.g., fluorine resins such as TEFLON and polyvinylidene fluoride; fluorine compounds such as carbon fluoride; fatty acid metal salts such as zinc stearate; fatty acids, and fatty acid derivatives such as fatty esters; and molybdenum sulfide.

The toner for developing electrostatic latent images according to the present invention, constituted as described above, may be used alone as a non-magnetic one-component developer, or may constitute a magnetic two-component developer together with a magnetic carrier so as to be used as the magnetic two-component developer, or a magnetic material may be incorporated into toner particles so as to be used as a magnetic one-component developer.

Carrier

Here, as the carrier used as that for the two-component developer, any of conventionally known carriers may be used. Stated specifically, they are those formed of metals such as iron, nickel, cobalt, manganese, chromium and rare earth elements, and alloys or oxides thereof, having been surface-oxidized or unoxidized. Particles having an average particle diameter of from 20 to 300 μm which are formed of any of these materials may be used. Also, it is preferable to use carriers comprising such carrier particles to or on the surfaces of which a material such as a styrene resin, an acrylic resin, a silicone resin, a fluorine resin or a polyester resin has been deposited or coated.

Magnetic Toner

The toner for developing electrostatic latent images according to the present invention may also be used as a magnetic toner (which may also be termed as a magnetic one-component developer) by incorporating a magnetic material into toner particles. In this case, the magnetic material may also be made to serve as the colorant. The magnetic material used here may include magnetite and the like. As these magnetic material usable in the present invention, those having an average particle diameter of from 2 μm or less, and preferably approximately from 0.1 to 0.5 μm, are preferred. As its quantity in which it is incorporated in the toner, it may preferably be used in an amount of from 20 to 200 parts by mass based on 100 parts by mass of the binder resin, and particularly in an amount of from 40 to 150 parts by mass based on 100 parts by mass of the binder resin.

Toner Production Process

As a specific process for producing the toner for developing electrostatic latent images according to the present invention, constituted as described above, any conventionally known process may be used.

The toner for developing electrostatic latent images according to the present invention may be produced by, e.g., what is called a pulverization process, which produces the toner according to the following steps.

Stated specifically, the charge control resin, resins such as the binder resin, and a wax optionally added are thoroughly mixed by means of a mixing machine such as Henschel mixer or a ball mill. Then the mixture obtained is melt-kneaded using a heat kneading machine such as a heating roll, a kneader or an extruder to make the resins melt one another, in which the pigment, dye or magnetic material as the colorant and additives such as a metal compound optionally added are then dispersed or dissolved, followed by cooling for solidification. Thereafter, the solidified product is pulverized by means of a grinding machine such as a jet mill or a ball mill, followed by classification. Thus, the toner for developing electrostatic latent images according to the present invention, having the desired particle diameter, can be obtained. Incidentally, in the step of classification, a multi-division classifier may preferably be used in view of production efficiency.

The toner for developing electrostatic latent images according to the present invention, having the desired particle diameter, may also be obtained by mixing the binder resin and the charge control resin in the form of a solution by using a solvent (such as toluene or xylene), stirring the solution, and thereafter introducing the resultant solution into water or other non-solvent to effect reprecipitation, followed by filtration and then drying, and thereafter pulverizing the solidified product by means of a grinding machine such as a jet mill or a ball mill, followed by classification. Incidentally, in the step of classification, a multi-division classifier may preferably be used in view of production efficiency.

The toner for developing electrostatic latent images according to the present invention may still also be produced by what is called a polymerization process as described below.

That is, in this case, materials such as the charge control resin, the polymerizable monomer, the pigment, dye or magnetic material as the colorant, and optionally the cross-linking agent, the polymerization initiator, the wax and other additives are mixed and dispersed to prepare a polymerizable monomer composition, which is then subjected to suspension polymerization in an aqueous dispersion medium in the presence of a surface-active agent or the like to synthesize polymerized color resin particles. The resin particles thus obtained are solid-liquid separated, followed by drying and then optionally classification to obtain the toner for developing electrostatic latent images according to the present invention.

As a further method, colored fine particles not containing any charge control resin may be prepared by the above process, and then the charge control resin may be added thereto alone, or together with an external additive such as colloidal silica, by a mechanochemical method to cause the latter to adhere to the former's particle surfaces.

In order to achieve much higher image quality, it is preferable that, e.g., the toner for developing electrostatic latent images according to the present invention has toner particles so regulated as to have weight-average particle diameter within the range of from 4 μm to 9 μm. That is, toner particles having a weight-average particle diameter of less than 4 μm are not preferable because they may cause a lowering of transfer efficiency and hence transfer residual toner tends to remain on the photosensitive member in a large quantity, tending to cause non-uniform or uneven images due to fog and faulty transfer. Also, toner particles having a weight-average particle diameter of more than 9 μm tend to cause spots around characters or line images.

In the present invention, the average particle diameter and particle size distribution of the toner are measured with a Coulter counter Model TA-II or Coulter Multisizer (manufactured by Coulter Electronics, Inc.). Then, an interface (manufactured by Nikkaki k.k.) that outputs number distribution and volume distribution and a personal computer PC9801 (manufactured by NEC.) are connected to make measurement. As an electrolytic solution used in the measurement, an aqueous 1% NaCl solution is prepared using first-grade sodium chloride. For example, commercially available, ISOTON R-II (available from Coulter Scientific Japan Co.) may be used as the electrolytic solution.

As a specific method for measurement, 0.1 to 5 ml of a surface active agent (preferably an alkylbenzene sulfonate) is added as a dispersant, to from 100 to 150 ml of the above aqueous electrolytic solution, and 2 to 20 mg of a toner sample is added to prepare a sample for measurement. In making the measurement, the electrolytic solution in which the sample has been suspended is subjected to dispersion for about 1 minute to about 3 minutes in an ultrasonic dispersion machine.

Thereafter, the volume distribution and number distribution are calculated by measuring the volume and number of toner particles of 2 μm or more in particle diameter by means of the above Coulter counter Model TA-II, using an aperture of 100 μm as its aperture. Then the values according to the present invention are determined, which are the volume-based, weight-average particle diameter determined from the volume distribution and the number-based, number-average particle diameter determined from number distribution.

Charge Quantity

The toner for developing electrostatic latent images according to the present invention may preferably have a charge quantity (two-component method) per unit weight, of from −10 to −80 μC/g, and more preferably from −15 to −70 μC/g. This is preferable in order to improve transfer efficiency in a transfer method making use of a transfer member to which a voltage is kept applied.

A method of measuring the charge quantity (two-component triboelectricity) by the two-component method usable in the present invention is described below. As a measuring device, a charge quantity measuring device shown in FIG. 1 is used.

First, using EFV200/300 (available from Powder Teck Co.) as a carrier, a mixture prepared by adding 0.5 g of a toner for measurement to 9.5 g of the carrier is put into a bottle with a volume of 50 to 100 ml, made of polyethylene, and is set on a shaker having a fixed shaking width, followed by shaking for a fixed time, setting shaking conditions at a shaking width of 100 mm and a shaking speed of 100 to-and-fro times per minute.

Then, in the charge quantity measuring device shown in FIG. 1, 1.0 to 1.2 g of the above mixture is put into a measuring container 42 made of a metal at the bottom of which a screen 43 of 500 meshes is provided, and the container is covered with a plate 44 made of a metal. The total weight of the measuring container 42 at this point is weighed and is expressed as W1 (g).

Next, in a suction device (not shown; made of an insulating material at least at the part coming into contact with the measuring container 42), air is sucked from a suction opening 47 and an air-flow control valve 46 is operated to control the pressure indicated by a vacuum indicator 45, so as to be 2,450 Pa (250 mmAq). In this state, suction is carried out for 1 minute to remove the toner by suction. The potential indicated by a potentiometer 49 at this point is expressed as V (volt). Herein, reference numeral 48 denotes a capacitor, whose capacitance is expressed as C (μF). Also, the total weight of the measuring device after completion of the suction is also weighed and is expressed as W2 (g). The triboelectric charge quantity (μC/g) of the toner is calculated from these measured values according to the following expression.

$$\text{Triboelectric charge quantity } (\mu C/g) = C \times V/(W1 - W2)$$

Molecular Weight Distribution of Binder Resin

As the binder resin constituting the toner for developing electrostatic latent images according to the present invention, it may preferably be made to have, in its molecular weight distribution as measured by GPC, a peak in the range of from 3,000 to 150,000 in the low-molecular weight region especially when the toner is produced by pulverization. That is, if the binder resin has the GPC peak at more than 150,000 in the low-molecular weight region, it may be difficult to obtain a toner improved sufficiently in transfer efficiency. Also, the use of a binder resin having the GPC peak at less than 3,000 in the low-molecular weight region is not preferable because it tends to cause melt adhesion when toner particles are surface-treated.

In the present invention, the molecular weight of the binder resin constituting the toner for developing electrostatic latent images may be measured by GPC (gel permeation chromatography).

A specific method for measurement by GPC is as follows:

A sample obtained by beforehand subjecting the toner for developing electrostatic latent images according to the present invention to extraction with THF (tetrahydrofuran) for 20 hours by means of a Soxhlet extractor is prepared as a sample for measurement. As column constitution, e.g., A-801, A-802, A-803, A-804, A-805, A-806 and A-807, available from Showa Denko K.K., are connected, and the molecular weight distribution is measured using a calibration curve of standard polystyrene resin.

In the toner for developing electrostatic latent images according to the present invention, it is preferable to contain as the binder resin a binder resin having the ratio of weight-average molecular weight (Mw) to number-average molecular weight (Mn), Mw/Mn, in the range of from 2 to 100, as measured in the manner as described above.

Glass Transition Point of Toner

It is further preferable that, by using appropriate materials, the toner for developing electrostatic latent images according to the present invention is so prepared as to have a glass transition point Tg of from 40° C. to 75° C., and more preferably from 52° C. to 70° C., in view of fixing performance and storage stability.

The glass transition point Tg in this case may be measured with, e.g., a differential scanning calorimeter of a highly precise, inner-heat input compensation type, such as DSC-7, manufactured by Perkin-Elmer Corporation.

As a measuring method, it may be measured according to ASTM D3418-82. In the present invention, in measuring the glass transition point Tg, a measuring sample is once heated to take a previous history and thereafter cooled rapidly. Then, the sample is again heated at a heating rate of 10° C./min. within the temperature range of 0 to 200° C., where the DSC curve thus measured may be used.

Although only some exemplary embodiments of this invention have been described in detail above, those skilled in the art will readily appreciate that many modifications are possible in the exemplary embodiments without materially departing from the novel techniques and advantages of this invention.

Accordingly, all such modifications are intended to be included within the scope of this invention.

EXAMPLES

The present invention is described below in greater detail by giving Examples and Comparative Examples. Incidentally, the following Examples are examples of the embodiments according to the present invention, and by no means limit the present invention. Also, "part(s)" in the following formulation is "part(s) by mass" in all occurrences.

Production of Charge Control Resin

Example A-1

Three shaking flasks of 2,000 ml in volume were readied. 0.5 wt. % of polypeptone (available from Wako Pure Chemical Industries, Ltd.), 6.0 mmoles of 5-(phenylsulfanyl) valeric acid and 1 mmole of 5-(4-biphenyl)valeric acid were dissolved in 1,000 ml of an M9 medium. The solution obtained was put into each flask, then sterilized using an autoclave, and thereafter cooled to room temperature.

To the culture mediums prepared, 10 ml each of a culture solution of *Pseudomonas cichorii* strain YN2 (International Deposition Number: FERM BP-7375) having previously been subjected to shaking culture in an M9 medium containing 0.5 wt. % of polypeptone for 8 hours was added to effect culture at 30° C. for 38 hours.

After the culture, the culture solutions obtained were gathered, and cells were collected by centrifugation, which were then washed with methanol, followed by drying. The resultant dried cells were weighed, and thereafter chloroform was added thereto, followed by stirring at 35° C. for 25 hours to extract a polymer. The chloroform in which the polymer was extracted was filtered with a membrane filter of 0.45 μm in pore diameter, and thereafter concentrated by means of an evaporator. Thereafter, the concentrated liquid was re-precipitated in cold methanol, where the polymer was collected, followed by drying under reduced pressure to obtain the desired polymer.

Composition of M9 Medium:

$Na_2HPO_4$: 6.3

$KH_2PO_4$: 3.0

$NH_4Cl$: 1.0

NaCl: 0.5

(g/L; pH: 7.0)

The polymer obtained was weighed. As the result, in this Example, 1,111 mg (dry weight) of PHA (polyhydroxyalkanoate) was obtained. Average molecular weight of the PHA was measured by gel permeation chromatography (GPC: Toso Corporation HLC-8220; column: Toso Corporation TSK-GEL Super HM-H; solvent: chloroform; in terms of polystyrene). As the result, it had a number-average molecular weight Mn of 105,000.

Further, the structure of the PHA obtained was determined by $^1$H-NMR (FT-NMR: Bruker DPX400; resonant frequency: 400 MHz; measurement nuclide: $^1$H; solvent used: di-DMSO; measurement temperature: room temperature). As the result, this was confirmed to be a polyhydroxyalkanoate (PHA) copolymer containing as monomer units a 3-hydroxy-5-(phenylsulfanyl)valeric acid unit and a 3-hydroxy-ω-(4-vinylphenyl)valeric acid unit, represented by the following chemical formula (1).

(1)

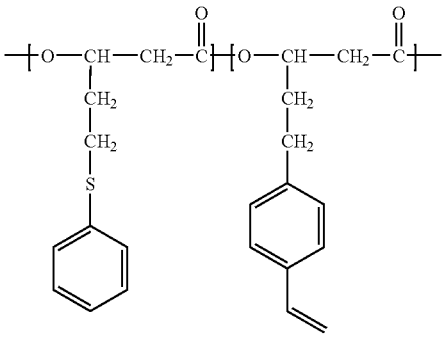

A B (2)

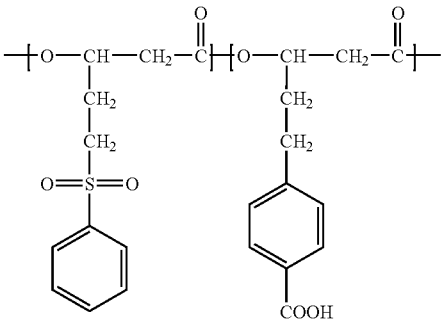

A B

The units were also found from the $^1$H-NMR spectrum to be in a proportion as shown below.

3-Hydroxy-5-(phenylsulfanyl)valeric acid unit: 70 mole %; 3-hydroxy-ω-(4-vinylphenyl)valeric acid unit: 20 mole %; and other (straight-chain 3-hydroxyalkanoic acid having 4 to 12 carbon atoms): 10 mole %.

Example A-2

302 mg of the polyhydroxyalkanoate (PHA) obtained in Example A-1 was put into a 200 ml egg-plant type flask, and 20 ml of dichloromethane was added thereto to effect dissolution. This was placed under ice bathing, and 3 ml of acetic acid and 1,103 mg of 18-crown-6-ether were added thereto, followed by stirring. Next, 877 mg of potassium permanganate was slowly added under ice bathing, followed by stirring at room temperature for 21 hours. After the reaction was completed, 50 ml of water and 3,050 mg of sodium hydrogensulfite were added.

Thereafter, the quality of the solution was adjusted to pH 1 with 1.0 mol/L (1.0 N) hydrochloric acid. After the dichloromethane in the mixture solution was evaporated off by means of an evaporator, the polymer in the solution was collected. This was washed with 150 ml of pure water, thereafter washed with 150 ml of methanol, further washed twice with 150 ml of pure water, and finally washed with 50 ml of methanol, where the polymer was collected, followed by drying under reduced pressure to obtain 342 mg of the desired PHA.

Further, to specify the structure of the PHA obtained, the PHA was analyzed by $^1$H-NMR (FT-NMR: Bruker DPX400; resonant frequency: 400 MHz; measurement nuclide: $^1$H; solvent used: di-DMSO; measurement temperature: room temperature). As the result, this was confirmed to be a polyhydroxyalkanoate copolymer containing as monomer units a 3-hydroxy-5-(phenylsulfonyl)valeric acid unit and a 3-hydroxy-ω-(4-carboxyphenyl)valeric acid unit, represented by the following chemical formula (2).

To further calculate the units of the PHA obtained, the carboxyl group present at the side chain terminal of the PHA was methyl-esterified in the following way by the use of trimethylsilyldiazomethane to make calculation.

30 mg of the desired product PHA was put into a 100 ml volume egg-plant type flask, and 2.1 ml of chloroform and 0.7 ml of methanol were added thereto to effect dissolution. To this solution, 0.5 ml of a 2 mole/l trimethylsilyldiazomethane-hexane solution (available from Aldrich Chemical Co., Inc.) was added, followed by stirring at room temperature for 30 minutes. After the reaction was completed, the solvents were evaporated off by means of an evaporator, and thereafter the polymer was collected. This was washed with 50 ml of methanol, and thereafter the polymer was collected, followed by drying under reduced pressure to obtain 31 mg of the PHA.

NMR analysis was carried out by the same method as the above. As the result, the units were confirmed from the $^1$H-NMR spectrum to be in a proportion of 3-hydroxy-5-(phenylsulfonyl)valeric acid unit: 74 mole %; 3-hydroxy-ω-(4-carboxyphenyl)valeric acid unit: 17 mole %; and other (straight-chain 3-hydroxyalkanoic acid having 4 to 12 carbon atoms): 9 mole %.

Example A-3

In 1,000 ml of the M9 medium shown previously in Example A-1, 5.0 g of polypeptone (available from Wako Pure Chemical Industries, Ltd.) and 0.8912 g of 5-phenylvaleric acid were dissolved. The solution obtained was put into a 2,000 ml volume shaking flask, and was sterilized using an autoclave. After the solution was thus sterilized with heating, this was cooled to room temperature, and 0.2043 g of 5-(4-vinylphenyl)valeric acid was added, followed by thorough stirring to prepare a culture medium.

*Pseudomonas cichorii* strain YN2 was previously inoculated into an M9 medium containing 0.5 wt. % of polypeptone, and shaking culture was carried out at 3° C. for 8 hours to prepare a cell culture solution. To the above culture medium containing the substrates 5-(4-vinylphenyl)valeric acid and 5-phenylvaleric acid, 5 ml of this culture solution was added to carry out culture at 30° C. for 39 hours. After the culture, cells were collected by centrifugation, which were then washed with methanol, followed by freeze drying.

The resultant dried cells were weighed, and thereafter chloroform was added thereto, followed by stirring at 25° C. for 72 hours to extract the polymer accumulated in the cells. The chloroform in which the polymer extracted stood dissolved was filtered. The chloroform filtrate obtained was concentrated by means of an evaporator. Thereafter, the polymer was again dissolved in acetone, and insoluble matter was removed by filtration. Then, the filtrate obtained was concentrated by means of an evaporator, and thereafter portions precipitated in cold methanol and solidified were gathered, followed by drying under reduced pressure, where the desired polymer was collected. The polymer thus collected through the above collection steps was weighed as its dry weight.

As to the polymer collected, its structure was determined by $^1$H-NMR (FT-NMR: Bruker DPX400; $^1$H resonant frequency: 400 MHz; measurement nuclide: $^1$H; solvent used: $CDCl_3$; reference: capillary-encapsulated TMS/$CDCl_3$; measurement temperature: room temperature). As the result, this was confirmed to be a polyhydroxyalkanoate (PHA) copolymer containing units represented by the following chemical formula (3), in a content ratio (mole %) of A:B=83:17

(3)

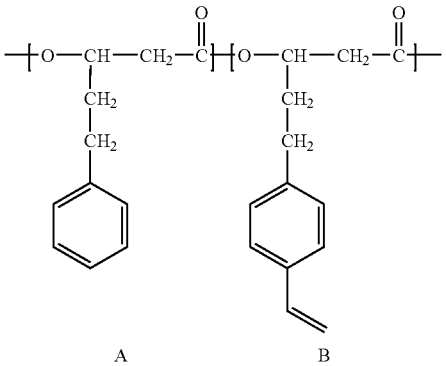

A B

In addition, the average molecular weight of such a polymer was measured by gel permeation chromatography (GPC) (Toso Corporation HLC-8220 GPC; column: Toso Corporation TSK-GEL Super HM-H; solvent: chloroform; in terms of polystyrene).

The dry weight of the cells obtained in the above steps, the dry weight of the polymer collected, the weight ratio per dried cells, of the polymer collected, and the number-average molecular weight, weight-average molecular weight and molecular weight distribution of the polymer obtained are shown together in Table 1.

TABLE 1

| CDW (mg/l) | PDW (mg/l) | P/C (%) | Mn ($\times 10^4$) | Mw ($\times 10^4$) | Mw/Mn |
|---|---|---|---|---|---|
| 1,205 | 600 | 49.8 | 5.9 | 12.1 | 2.1 |

CDW: Cell dry weight
PDW: Polymer dry weight
P/C: Cell dry weight/polymer dry weight
Mn: Number-average molecular weight
Mw: Weight-average molecular weight
Mw/Mn: Molecular weight distribution Example A-4

In an atmosphere of nitrogen, 0.3061 g of polyester containing a 3-hydroxy-ω-(4-vinylphenyl)valeric acid unit, 0.1923 g of 18-crown-6-ether and 10.0 ml of dichloromethane were put into a 100 ml flask, and stirred. The flask was immersed in an ice bath to make the reaction system kept at 0° C. After 30 minutes, 0.1517 g of potassium permanganate was added, and the reaction vessel was wrapped with aluminum foil, followed by stirring for 21 hours. After the reaction was completed, water in which sodium hydrogensulfite was dissolved was added, and the reaction solution formed was re-precipitated in methanol, whereby the polymer was collected. The polymer obtained here was dialyzed using chloroform to effect purification.

The structure of the polymer obtained was determined by analysis carried out by $^1$H-NMR (FT-NMR: Bruker DPX400; resonant frequency: 400 MHz; measurement nuclide: $^1$H; solvent used: dichloroform; measurement temperature: room temperature) and Fourier transformation infrared absorption (FT-IR) spectroscopy (Nicolet AVATAR360 FT-IR). As the result, from the fact that absorption due to carboxylic acid was newly seen at 1,693 $cm^{-1}$, it turned out that the PHA obtained had a 3-hydroxy-ω-(4-carboxyphenyl)valeric acid unit.

To further calculate the units of the PHA obtained, the carboxyl group present at the side chain terminal of the PHA was methyl-esterified in the following way by the use of trimethylsilyldiazomethane to make calculation.

30 mg of the desired product PHA was put into a 100 ml volume egg-plant type flask, and 2.1 ml of chloroform and 0.7 ml of methanol were added thereto to effect dissolution. To this solution, 0.5 ml of a 2 mole/l trimethylsilyldiazomethane-hexane solution (available from Aldrich Chemical Co., Inc.) was added, followed by stirring at room temperature for 30 minutes. After the reaction was completed, the solvents were evaporated off by means of an evaporator, and thereafter the polymer was collected. This was washed with 50 ml of methanol, and thereafter the polymer was collected, followed by drying under reduced pressure to obtain 32 mg of the PHA.

NMR analysis was carried out by the same method as the above. As the result, it turned out that the PHA contained 17 mole % of 3-hydroxy-ω-(4-carboxyphenyl)valeric acid unit.

Example N-1

Making reference to JOURNAL OF POLYMER SCIENCE, Polymer Chemistry Edition, 13, 1879-1887 (1975), styrene and acrylic acid were copolymerized to synthesize a polymer (copolymer) containing units represented by the following formula (N-0):

(N-0)

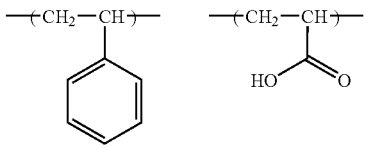

(NM) (NF)

in a content ratio (mole %) of (NM):(NF)=94.6, and this was used in the following experiment.

In an atmosphere of nitrogen, 1.5012 g of the polymer and 1.2868 g of 2-aminobenzenesulfonic acid were put into a 200 ml three-necked flask, and stirred with addition of 56.5 ml of pyridine. Thereafter, 3.89 ml of triphenyl phosphite was added, followed by heating at 120° C. for 6 hours. After the reaction was completed, the pyridine was evaporated off, and the product was dissolved in 150 ml of ethyl acetate, followed by separatory washing with 2N hydrochloric acid, which was repeatedly carried out three times to effect purification. Further, the solvent was evaporated off, and the polymer was dissolved in 15 ml of THF, re-precipitated in 200 ml of 2-propanol and thereafter collected by filtration, followed by drying under reduced pressure.

As the result of $^1$H-NMR, from the fact that a peak due to the phenyl group of the 2-aminobenzenesulfonic acid stood shifted, the polymer obtained was confirmed to be a polymer (copolymer) containing 6 mole % of a unit represented by the following formula (N-1).

(N-1)

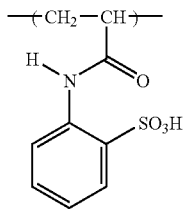

As to the average molecular weight of the polymer obtained, it had a number-average molecular weight Mn of 23,000 and a weight-average molecular weight Mw of 54,000.

The preparation process was scaled up to obtain 50 g of the compound, and this compound was designated as Exemplary Compound N-1, which was use in preparing toners and in evaluation.

Example N-2

0.9980 g of the polymer obtained in Example N-1 was put into a 300 ml egg-plant type flask, and 70 ml of chloroform and 17.5 ml of methanol were added thereto to effect dissolution, followed by cooling to 0° C. To this solution, 4.95 ml of a 2 mole/l trimethylsilyldiazomethane-hexane solution (available from Aldrich Chemical Co., Inc.) was added, followed by stirring for 4 hours. After the reaction was completed, the solvents were evaporated off by means of an evaporator, and thereafter the polymer was collected. Further, 70 ml of chloroform and 17.5 ml of methanol were added thereto to make the polymer dissolve again, and the solvents were evaporated off by means of an evaporator. This operation was repeatedly carried out three times. The polymer collected here was dried under reduced pressure to obtain 0.9898 g of the polymer. As the result of $^1$H-NMR, from the fact that a peak due to methyl sulfonate was seen at 3 to 4 ppm, the polymer obtained was confirmed to be a polymer (copolymer) containing 6 mole % of a unit represented by the following formula (N-2).

(N-2)

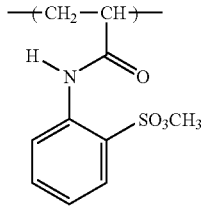

Incidentally, a $^1$H-NMR chart obtained is shown in FIG. 2.

As the result of acid-value titration, from the fact that no equivalence point due to sulfonic acid was seen, it was also turned out that sulfonic acid came into methyl sulfonate.

As to the average molecular weight of the polymer obtained, it had a number-average molecular weight Mn of 22,000 and a weight-average molecular weight Mw of 54,000.

The preparation process was scaled up to obtain 50 g of the compound, and this compound was designated as Exemplary Compound N-2, which was use in preparing toners and in evaluation.

Example L-1

Production of LCR Monomer (10)

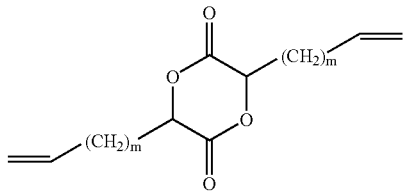

(m is an integer selected from 2 to 8.)

Synthesis of 3,6-di-(3-butenyl)-1,4-dioxane-2,5-dione represented by the chemical formula (10) in which m is 2, from 2-hydroxy-5-hexenoic acid:

3.0 g of 2-hydroxy-5-hexenoic acid, 400 ml of toluene and 30 mg of p-toluenesulfonic acid were put into a 1 liter flask provided with a reflux condenser and Dean-Stark trap, and were refluxed in an atmosphere of nitrogen. The water having gathered in the trap was removed on demand. After refluxing for 72 hours, the liquid was cooled. This was washed twice with an aqueous 10 ml saturated sodium hydrogencarbonate. Thereafter, the crude product obtained was distilled under reduced pressure in the presence of zinc oxide to obtain 1.06 g of 3,6-di-(ω'-butenyl)-1,4-dioxane-2,5-dione (yield: 41%).

To specify the structure of the compound obtained, NMR analysis was carried out under the following conditions.

<Measuring Instrument>
FT-NMR: Bruker DPX400.
Resonant frequency: $^1$H=400 MHz

<Measuring Conditions>
Measurement nuclide: $^1$H.
Solvent used: DMSO-$d_6$.
Measurement temperature: room temperature.

As the result, the compound obtained was confirmed to be the desired 3,6-di-(3-butenyl)-1,4-dioxane-2,5-dione.

Example L-2

LCR Copolymerization

Synthesis of polyester by using 3,6-di-(3-butenyl)-1,4-dioxane-2,5-dione and L-lactide:

0.11 g (0.5 mmole) of 3,6-di-(3-butenyl)-1,4-dioxane-2,5-dione, 0.65 g (4.5 mmoles) of L-lactide, 2 ml of a toluene solution of 0.01M tin octilate (tin 2-ethylhexanoate) and 2 ml of a toluene solution of 0.01M p-tert-benzylalcohol were put into a polymerization ampule, which was then dried under reduced pressure for 1 hour and nitrogen-displaced, and was thereafter heat-sealed under reduced pressure, followed by heating to 150° C. to carry out ring-opening polymerization. After 1 hour, the reaction was completed, followed by cooling. The polymer obtained was dissolved in chloroform, and then re-precipitated in methanol which was in a quantity ten times that of the chloroform required for dissolution. The precipitate was collected and then dried under reduced pressure to obtain 0.63 g of the polymer.

To specify the structure of the compound obtained, NMR analysis was carried out under the following conditions.

<Measuring Instrument>
FT-NMR: Bruker DPX400.
Resonant frequency: $^1H$=400 MHz

<Measuring Conditions>
Measurement nuclide: $^1H$.
Solvent used: TMS/$CDCl_3$.
Measurement temperature: room temperature.

As the result, this compound was confirmed to be a polyhydroxyalkanoate copolymer containing as monomer units the units represented by the following chemical formula (52). The monomer units were also confirmed to be in a proportion that the A unit was 9 mole % and the B unit was 91 mole %.

(52)

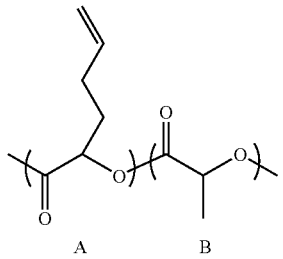

Average molecular weight of the polyhydroxyalkanoate obtained was measured by gel permeation chromatography (GPC: Toso Corporation HLC-8220; column: Toso Corporation TSK-GEL Super HM-H; solvent: chloroform; in terms of polystyrene). As the result, it had a number-average molecular weight Mn of 18,200 and a weight-average molecular weight Mw of 24,000.

Example L-3

LCR Oxidation Reaction/COOH Group Addition

Oxidation reaction of polyhydroxyalkanoate composed of the units represented by the chemical formula (52), synthesized in Example L-2:

(52)

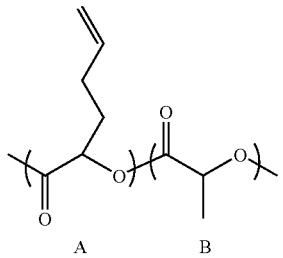

0.50 g of the polyhydroxyalkanoate composed of the units represented by the chemical formula (52) (A: 9 mole %; B: 91 mole %), synthesized in Example L-2, was put into an egg-plant type flask, and 30 ml of acetone was added thereto to effect dissolution. This was placed under ice bathing, and 5 ml of acetic acid and 0.47 g of 18-crown-6-ether were added thereto, followed by stirring. Next, 0.38 g of potassium permanganate was slowly added under ice bathing, followed by stirring under ice bathing for 2 hours and further stirring at room temperature for 18 hours. After the reaction was completed, 60 ml of ethyl acetate was added and 45 ml of water was further added. Next, sodium hydrogensulfite was added until peracid was removed.

Thereafter, the quality of the solution was adjusted to pH 1 with 1.0 N hydrochloric acid. The organic layer was extracted, and then washed three times with 1.0N hydrochloric acid. After the organic layer was collected, the solvents were evaporated off, whereby a crude product polymer was collected. Next, this was washed with 50 ml of water, then with 500 ml of methanol, and further washed three times with 50 ml of water, and thereafter the polymer was collected. Next, this was dissolved in 3 ml of THF (tetrahydrofuran), and then re-precipitated in methanol which was in a quantity fifty times that of the THF required for dissolution. The precipitate was collected and then dried under reduced pressure to obtain 0.44 g of the polymer.

To specify the structure of the polymer obtained, NMR analysis was carried out under the same conditions as those in Example L-2. As the result, this was confirmed to be a polyhydroxyalkanoate containing as monomer units the units represented by the following chemical formula (64).

(64)

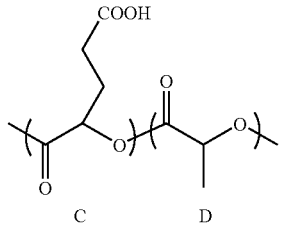

Average molecular weight of the polyhydroxyalkanoate obtained was measured by gel permeation chromatography (GPC: Toso Corporation HLC-8220; column: Toso Corporation TSK-GEL Super HM-H; solvent: chloroform; in terms of polystyrene). As the result, it had a number-average molecular weight Mn of 13,200 and a weight-average molecular weight Mw of 18,200.

To further calculate the units of the polyhydroxyalkanoate obtained, the carboxyl group present at the side chain terminal of the polyhydroxyalkanoate was methyl-esterified in the following way by the use of trimethylsilyldiazomethane to make calculation.

30 mg of the desired product polyhydroxyalkanoate was put into a 100 ml volume egg-plant type flask, and 2.1 ml of chloroform and 0.7 ml of methanol were added thereto to effect dissolution. To this solution, 0.5 ml of a 2 mole/l trimethylsilyldiazomethane-hexane solution was added, followed by stirring at room temperature for 1 hour. After the reaction was completed, the solvents were evaporated off, and thereafter the polymer was collected. This was washed with 50 ml of methanol, and thereafter the polymer was collected, followed by drying under reduced pressure to obtain 31 mg of the polyhydroxyalkanoate.

NMR analysis was carried out by the same method as in Example L-2. As the result, this compound was confirmed to be a polyhydroxyalkanoate copolymer having the units represented by the chemical formula (64), in a proportion that the C unit was 8 mole % and the D unit was 92 mole %.

Example L-4

LCR Condensation

Condensation reaction of polyhydroxyalkanoate composed of the units represented by the chemical formula (64), synthesized in Example L-3, with 2-aminobenzenesulfonic acid:

(64)

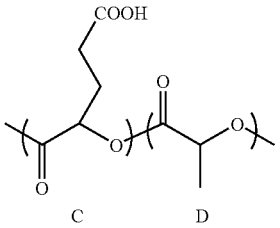

In an atmosphere of nitrogen, 0.40 g of the synthetic polymer polyhydroxyalkanoate copolymer composed of the units represented by the chemical formula (64) (C: 8 mole %; D: 92 mole %), obtained in Example L-3, and 0.36 g of 2-aminobenzenesulfonic acid were put into a 100 ml three-necked flask, and stirred with addition of 15.0 ml of pyridine. Thereafter, 1.09 ml of triphenyl phosphite was added, followed by heating at 120° C. for 6 hours. After the reaction was completed, the product was re-precipitated in 150 ml of ethanol to collect the polymer. The polymer obtained was washed with 1N hydrochloric acid for a day, and thereafter stirred in water for a day to carry out washing, followed by drying under reduced pressure to obtain 0.32 g of the polymer.

The structure of the polymer obtained was determined by analysis carried out by $^1$H-NMR (FT-NMR: Bruker DPX400; resonant frequency: 400 MHz; measurement nuclide: $^1$H; solvent used: di-DMSO; measurement temperature: room temperature) and Fourier transformation infrared absorption (FT-IR) spectroscopy (Nicolet AVATAR360 FT-IR). As the result of IR measurement, a peak at 1,695 cm$^{-1}$ due to carboxylic acid came smaller and a peak due to the amide group was newly seen at 1,658 cm$^{-1}$.

As the result of $^1$H-NMR, from the fact that a peak due to the aromatic group of the 2-aminobenzenesulfonic acid stood shifted, the polymer obtained was confirmed to be a polyhydroxyalkanoate containing as monomer units the units represented by the following chemical formula (75).

(75)

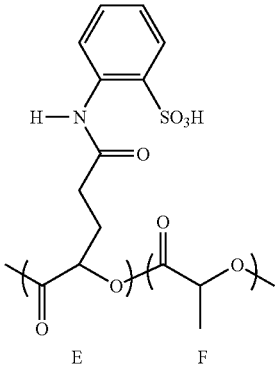

The units of the polyhydroxyalkanoate, represented by the chemical formula (75), were also confirmed to be in a proportion that the E unit was 8 mole % and the F unit was 92 mole %.

Average molecular weight of the polymer obtained was measured by gel permeation chromatography (GPC: Toso Corporation; column: Polymer Laboratories PLgel 5μ MIXED-C; solvent: DMF/LiBr 0.1% (w/v); in terms of polystyrene). As the result, it had a number-average molecular weight Mn of 11,300 and a weight-average molecular weight Mw of 16,000.

Example L-5

LCR Methyl Esterification—Material in Ex.B-5

Esterification reaction of polyhydroxyalkanoate composed of the units represented by the chemical formula (75), synthesized in Example L-4:

(75)

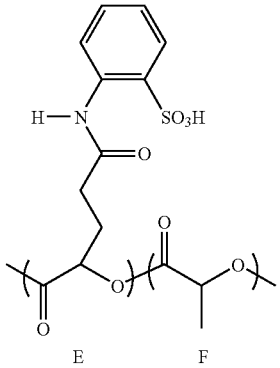

0.30 g of the polyhydroxyalkanoate copolymer composed of the units represented by the chemical formula (75) (E: 8 mole %; F: 92 mole %), obtained in Example L-3, was put into an egg-plant type flask, and 21.0 ml of chloroform and 7.0 ml of methanol were added thereto to effect dissolution, and the solution obtained was cooled to 0° C. To this solution, 1.36 ml of a 2 mole/l trimethylsilyldiazomethane-hexane solution (available from Aldrich Chemical Co., Inc.) was added, followed by stirring for 4 hours. After the reaction was completed, the solvents were evaporated off by means of an evaporator, and thereafter the polymer was collected.

Further, 21.0 ml of chloroform and 7.0 ml of methanol were added to again dissolve the polymer, and then the solvents were evaporated off by means of an evaporator. This operation was repeatedly carried out three times. The polymer collected here was dried under reduced pressure to obtain 0.31 g of the polymer.

The structure of the polymer obtained was determined by $^1$H-NMR (FT-NMR: Bruker DPX400; resonant frequency: 400 MHz; measurement nuclide: $^1$H; solvent used: di-DMSO; measurement temperature: room temperature). As the result of this $^1$H-NMR, from the fact that a peak due to methyl sulfonate was seen at 3 to 4 ppm, the polymer obtained was confirmed to be a polyhydroxyalkanoate containing as monomer units the units represented by the following chemical formula (97).

(97)

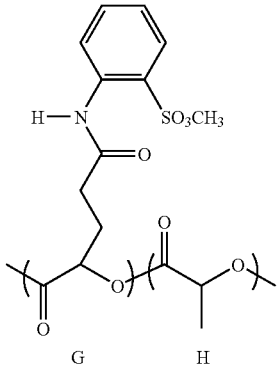

The units of the polyhydroxyalkanoate, represented by the chemical formula (97), were also confirmed to be in a proportion that the G unit was 8 mole % and the H unit was 92 mole %. Also, as the result of acid-value titration carried out using a potential difference titrator AT510 (manufactured by Kyoto Electronics Manufacturing Co., Ltd.), from the fact that no peak due to sulfonic acid was seen, it was also turned out that sulfonic acid came into methyl sulfonate.

Average molecular weight of the polymer obtained was measured by gel permeation chromatography (GPC: Toso Corporation; column: Polymer Laboratories PLgel 5μ MIXED-C; solvent: DMF/LiBr 0.1% (w/v); in terms of polystyrene). As the result, it had a number-average molecular weight Mn of 11,100 and a weight-average molecular weight Mw of 16,300.

Comparative Example A-1

In place of the substrates 5-(phenylsulfanyl)valeric acid and 5-(4-biphenyl)valeric acid used in Example A-1, 10-undecenoic acid and octanoic acid (90:10 mole/mole) were used as substrates. Except for this, the procedure of Example A-1 was repeated to produce PHA [poly(3-hydroxyoctanoate-co-3-hydroxyundecenoate)(PHO 90U10)] containing 3-hydroxy-10-undecenoic acid as a monomer unit.

Then, PHA [the following formula (4)] containing a 3-hydroxy-9-carboxynonanoic acid as a monomer unit was obtained which was synthesized by the oxidation cleavage reaction making use of potassium permanganate as described in Macromolecular Chemistry, 4, 289-293 (2001).

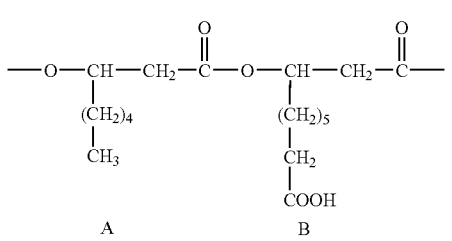

(4)

From the results of $^{1}$H-NMR, this was confirmed to be a polyhydroxyalkanoate copolymer having a content ratio (mole %) A:B of 90:10

In addition, the average molecular weight of such a polymer was measured by gel permeation chromatography (GPC) (Toso Corporation HLC-8220 GPC; column: Polymer Laboratories MIXED-C; solvent: tetrahydrofuran (THF); in terms of polystyrene). This polymer had a number-average molecular weight Mn of 53,800.

Preparation of Samples for Measurement with Scanning Probe Microscope, and Viscoelasticity Evaluation Next, in respect of the charge control resins of Examples A-2 and A-4, Comparative Example A-1, FCA (CA agent available from Fujikura Kasei Co., Ltd.), Example N-2 and Example L-5, samples for viscoelasticity evaluation by the scanning probe microscope were prepared and evaluated (Examples B-1, B-2, B-3, B-4 and B-5, and Comparative Examples B-1 and B-2).

Example B-1

100 parts by mass of styrene-butyl acrylate copolymer resin (A) (Mn: 3,400; Mw:170,000; Tm: 121° C.; Tg: 57° C.) as a binder resin was mixed with the charge control resin produced in Example A-2 in a proportion of 5:1, and the mixture obtained was kneaded by means of a 130° C. twin-screw extruder, followed by cooling. The mixed-resin block obtained was cut with a microtome to make a very smooth cut face. This cut face was observed on an optical microscope to ascertain that the compound of Example A-2, the charge control resin, stood dispersed in the binder resin in the form of spherical grains. The viscoelasticity of the spherical grains and that of the surrounding binder resin surface were evaluated by using the scanning probe microscope.

The measurement of the surface hardness, or viscoelasticity, with the scanning probe microscope was made in the following way. Measurement was made in the viscoelasticity evaluating force modulation mode, using Scanning Probe Microscope (SPM) Control Station, Model Nano Scope III, manufactured by Digital Instruments Co.

The probe was made of single-crystal silicon, and was 3.8 N/m in spring constant, 225 μm in length and 70.8 kHz in frequency. Using this probe, the viscoelasticity was measured in the air, setting scan size at 20 μl, scan rate at 0.5 Hz, and measurement temperature at 20° C., 45° C. and 70° C. The viscoelasticity of the sample surface is reflected in the amplitude of probe vibration and the phase changes of probe vibration.

In the measurement in the viscoelasticity evaluating force modulation mode, in the case when the sample surface is hard, the amplitude of probe vibration is large and is expressed in a large voltage value, and on the other hand in the case when the sample surface is soft, the amplitude is small and is expressed in a small voltage value. This is processed into images according to the tones of colors, where harder areas are so displayed as to appear dark. Also, at this point, differences in phases (Phase) of probe vibration come about simultaneously in the tapping mode. At soft sample surfaces, differences in phases come large, and on the other hand differences in phases come small at hard areas. This is processed into images according to the tones of colors, where softer areas are so displayed as to appear darker. The results of evaluation made according to the following criteria are shown in Table 2.

Viscoelasticity Evaluation (Force Modulation)

The value of [vibration amplitude (V) in the charge control resin region]−[vibration amplitude (V) in the binder resin region] is:

AA: 50 mV or more.

A: 0 to less than 50 mV.

B: 0 V.

C: 0 V or less.

(Phase)

The value of [differences (deg.) in phases in the binder resin region)−(differences (deg.) in the charge control resin region) is:

A: positive.

B: zero.

C: negative.

Example B-2

A sample for viscoelasticity evaluation by the scanning probe microscope was prepared in the same manner as in Example B-1 except that the resin obtained in Example A-4 was used as the charge control resin. This was evaluated by the same evaluation method and according to the same criteria as those in Example B-1 to obtain the results shown in Table 2.

Comparative Example B-1

A sample for viscoelasticity evaluation by the scanning probe microscope was prepared in the same manner as in Example B-1 except that the resin obtained in Comparative Example A-1 was used as the charge control resin. Its viscoelasticity was evaluated by the same evaluation method and according to the same criteria as those in Example B-1 to obtain the results shown in Table 2.

Example B-3

A styrene type negative charge control resin FCA-1001-N (copolymer resin of styrene and 2-acrylamido-2-methylpropanesulfonic acid (AMPS); softening point: 137° C.; available from Fujikura Kasei Co., Ltd.) was used as the charge control resin and the same styrene-butyl acrylate copolymer resin (A) as that used in Example B-1 was used as the binder resin. The respective resin blocks were fused by heating to form a double-layer structure. The resin block obtained was cut with a microtome to make a very smooth cut face having the double-layer structure. The measurement with the scanning probe microscope was made in the same manner as in Example B-1, and the evaluation was made according to the same criteria as those in Example B-1 to obtain the results shown in Table 2.

Example B-4

SCR-SPM Evaluation Sample

A sample for viscoelasticity evaluation by the scanning probe microscope was prepared in the same manner as in Example B-1 except that the resin obtained in Example N-2 was used as the charge control resin. This was evaluated by the same evaluation method and according to the same criteria as those in Example B-1 to obtain the results shown in Table 2.

Example B-5

LCR-SPM Evaluation Sample

A sample for viscoelasticity evaluation by the scanning probe microscope was prepared in the same manner as in Example B-1 except that the resin obtained in Example L-5 was used as the charge control resin. This was evaluated by the same evaluation method and according to the same criteria as those in Example B-1 to obtain the results shown in Table 2.

Comparative Example B-2

A sample for viscoelasticity evaluation by the scanning probe microscope was prepared in the same manner as in Example B-3 except that styrene-butyl acrylate copolymer resin (B) (Mn: 5,900; Mw:280,000; Tm: 121° C.; Tg: 69° C.) was used as the binder resin. This was evaluated by the same evaluation method and according to the same criteria as those in Example B-1 to obtain the results shown in Table 2.

TABLE 2

Results of Viscoelasticity Evaluation by Scanning Probe Microscope

| | | | Force modulation | | | Phase | | |
|---|---|---|---|---|---|---|---|---|
| | Binder resin | Charge control resin | 20° C. | 45° C. | 70° C. | 20° C. | 45° C. | 70° C. |
| Example: | | | | | | | | |
| B-1 | St-Ac (A) | Example A-2 | A | A | AA | A | A | A |
| B-2 | St-Ac (A) | Example A-4 | A | A | A | A | A | B |
| Comparative Example: | | | | | | | | |
| B-1 | St-Ac (A) | Example A-1 | A | B | C | A | B | C |
| Example: | | | | | | | | |
| B-3 | St-Ac (A) | FCA | A | A | B | A | A | B |
| B-4 | St-Ac (A) | Example N-2 | AA | AA | AA | AA | AA | AA |
| B-5 | St-Ac (A) | Example L-5 | AA | A | A | AA | A | A |
| Comparative Example: | | | | | | | | |
| B-2 | St-Ac (B) | FCA | B | B | C | B | B | C |

St-Ac: Styrene-buthylacrylate copolymer resin

Production of Toners, Chargeability Evaluation, Running Performance Evaluation

Various toners were produced in combination of the charge control resins with the binder resins as used in Examples B-1, B-2, B-3, B-4 and B-5 and Comparative Examples B-1 and B-2, and evaluated (Examples C-1, C-2, C-3, C-4 and C-5, and Comparative Examples C-1 and C-2).

Example C-1

| | (by mass) |
|---|---|
| Styrene-butyl acrylate copolymer resin (A) (glass transition temperature: 57° C.) | 100 parts |
| Carbon black (DBP oil absorption: 110 ml/100 g) | 5 parts |
| Charge control resin | 2 parts |

(Example A-2 Compound)

The materials formulated as above were melt-kneaded by means of a twin-screw extruder (L/D: 30) set at 130° C. The kneaded product obtained was cooled, and the cooled product was crushed using a hammer mill, followed by pulverization by means of a jet mill and thereafter classification to obtain particles. The particles obtained had a weight-average particle diameter of 6.2 μm and a fine-powder content of 4.7% by number.

In 100 parts by mass of the particles, 1.5 parts by mass of a fluidity improver, hydrophobic fine silica powder (BET specific surface area: 250 $m^2/g$) treated with hexamethyldisilazane was mixed by means of Henschel mixer to obtain toner particles of this Example. Further, 7 parts by mass of the toner particles thus obtained and 93 parts by mass of a resin-coated magnetic ferrite carrier (average particle diameter: 45 μm) were blended to prepare a two-component developer for magnetic-brush development.

Example C-2

A developer was prepared in the same manner as in Example C-1 except that the charge control resin obtained in Example A-4 was used.

Comparative Example C-1

A developer was prepared in the same manner as in Example C-1 except that the charge control resin obtained in Comparative Example A-1 was used.

Example C-3

A developer was prepared in the same manner as in Example C-1 except that FCA resin used in Example B-3 was used as the charge control resin.

Example C-4

SCR-Containing Developer

A developer was prepared in the same manner as in Example C-1 except that the charge control resin obtained in Example N-2 was used.

Example C-5

SCR-containing Developer

A developer was prepared in the same manner as in Example C-1 except that the charge control resin obtained in Example L-5 was used.

Comparative Example C-2

A developer was prepared in the same manner as in Example C-3 except that the styrene-butyl acrylate copolymer resin (B) (glass transition temperature: 69° C.) used in Comparative Example B-2 was used as the binder resin.

Evaluation

In respect of the developers obtained in the above Examples C-1, C-2, C-3, C-4 and C-5 and Comparative Examples C-1 and C-2, the charge quantity of each toner after agitation for 10 seconds and and that for 300 seconds was measured in a normal-temperature and normal-humidity environment (25° C./60% RH) and a high-temperature and high-humidity environment (30° C./80% RH) and by the charge quantity measuring method described previously. The measured values of the charge quantity was rounded off to two decimal places, and evaluation was made according to the following criteria. Results obtained are shown together in Table 3.

Chargeability:

AA: Very good (−20 μC/g or less).

A: Good (from −19.9 to −10.0 μC/g or less).

B: Tolerable in practical use (from −9.9 to −5.0 μC/g).

C: Intolerable in practical use (−4.9 μC/g or more).

TABLE 3

Results of Chargeability Evaluation

| | Particle size distribution | | Chargeability | | | |
|---|---|---|---|---|---|---|
| | | | Normal temp./normal humidity | | High temp./high humidity | |
| | Average particle diameter (μm) | Fine-powder content (%) | 10 seconds | 300 seconds | 10 seconds | 300 seconds |
| Example: | | | | | | |
| C-1 | 6.2 | 4.7 | AA | AA | AA | AA |
| C-2 | 6.5 | 4.8 | AA | AA | AA | AA |
| Comparative Example: | | | | | | |
| C-1 | 6.7 | 4.1 | AA | AA | AA | AA |
| Example: | | | | | | |
| C-3 | 6 | 4.6 | AA | AA | AA | AA |
| C-4 | 6.6 | 4 | AA | AA | AA | AA |
| C-5 | 6.3 | 4.2 | AA | AA | AA | AA |
| Comparative Example: | | | | | | |
| C-2 | 6.8 | 4.5 | AA | AA | AA | AA |

The following various running tests were conducted using a commercially available electrophotographic copying machine NP-2020 (manufactured by CANON INC.). Results obtained are shown in Table 4.

Fixing Performance Test:

Fixing performance was evaluated in a first-copy test at 75° C. To evaluate the fixing performance, images formed were rubbed with Silbon paper ten times in a to-and-fro motion under a load of about 100 g, and any come-off of the images was examined to make evaluation by the rate (%) of decrease in reflection density.

Offset Test:

An image was copied on 200 transfer sheets of a B5 size, and thereafter immediately copied on an A3 transfer sheet, and evaluation was made on whether or not any high-temperature offset due to a rise in temperature at end areas causes image contamination.

AA: Very good (no offset occurred at all).

A: Good (offset occurred very little).

B: Tolerable in practical use (offset occurred a little).

C: Intolerable in practical use (offset occurred greatly).

Running Performance Test:

A 10,000 sheet running test was conducted in an environment of 32.5° C. to make evaluation on image density (as Dmax), fog, and contamination of the fixing roller cleaning roller (as hood contamination).

The fog and hood contamination were evaluated according to the following criteria.

AA: Very good (neither fog nor hood contamination occurs at all).

A: Good (fog and hood contamination occur very little).

B: Tolerable in practical use (fog and hood contamination occur a little).

C: Intolerable in practical use (fog and hood contamination occur greatly).

Blocking Test:

About 20 g of each developer was put into a 100 cc plastic cup, and was left at 50° C. for 3 days. Thereafter, how it stood was visually evaluated.

AA: Very good (no agglomerate is seen).

A: Good (agglomerates are seen, but break with ease).

B: Tolerable (agglomerates are seen, but break when shaked).

C: Intolerable (agglomerates are holdable, and do not break with ease).

TABLE 4

Running Test Results

| | Running performance | | | | | | Anti- |
|---|---|---|---|---|---|---|---|
| | Image density Dmax | | | Hood | Fixing | Image offset | blocking |
| | Start | 10,000 sheets | Fog | contamination | performance | properties | properties |
| Example: | | | | | | | |
| C-1 | 1.38 | 1.39 | AA | AA | 5% | AA | AA |
| C-2 | 1.37 | 1.37 | A | A | 5% | A | A |
| Comparative Example: | | | | | | | |
| C-1 | 1.35 | 1.21 | B | B | 4% | C | C |
| Example: | | | | | | | |
| C-3 | 1.4 | 1.39 | AA | AA | 5% | AA | AA |
| C-4 | 1.41 | 1.35 | AA | AA | 4% | AA | AA |
| C-5 | 1.4 | 1.38 | AA | AA | 4% | AA | AA |
| Comparative Example: | | | | | | | |
| C-2 | 1.39 | 1.3 | B | B | 7% | A | AA |

The use of what is embodied in the present invention can provide a toner for developing electrostatic images which has superior developing performance over long-term running, further less causes fog, and also has superior environmental properties and safety.

This application claims priority from Japanese Patent Application No. 2004-358390 filed on Dec. 10, 2004, which is hereby incorporated by reference herein.

What is claimed is:

1. A toner for developing an electrostatic image comprising:

a colorant;

a binder resin; and a charge control resin;

said charge control resin having hardness which is the same as the hardness of said binder resin or said charge control resin being harder than said binder resin, as measured by a force modulation mode as a viscoelasticity evaluating mode of a scanning probe microscope in respect to the binder resin and the charge control resin which are present in the particle interiors or particle surfaces of the toner, wherein in the force of modulation mode of the viscoelasticity evaluating mode of the scanning probe microscope (a) an amplitude of probe vibration of the charge control resin region is greater than amplitude of probe vibration of the binder resin region: and (b) a difference between the value of the amplitude of probe vibration in the charge control resin region and of the amplitude of probe vibration in the binder resin region is 50 m V or more; and in a tapping mode of the viscosity evaluating mode of the scanning probe microscope where probe vibration produces a delay of phases between applied signals and response signals, a difference in phases in the charge control resin region is smaller than a difference in phases in the binder resin region, said charge control resin is a positive charge control resin or a negative charge control resin, wherein said negative charge control resin is a polyhydroxyalkanoate polymer having monomer units having a carboxyl group or a sulfo group as a functional group.

2. The toner for developing an electrostatic image according to claim 1, which toner has a structure in which, at or in its particle surfaces or interiors, the charge control resin distributes in island shaped domains in respect to the binder resin.

3. The toner for developing an electrostatic image according to claim 1, wherein the measurement in a viscoelasticity evaluation mode is made at a temperature of 70° C. or less.

4. The toner for developing an electrostatic image according to claim 1, wherein said charge control resin has a melting point or a glass transition point within the range of from 20° C. to 150° C.

5. The toner for developing an electrostatic image according to claim 1, wherein said charge control resin has hardness which is the same as the hardness of said binder resin or said charge control resin is harder than the binder resin, when evaluated by measurement with a scanning probe microscope in the tapping mode in addition to a measurement by the force modulation mode.

6. An image forming method comprising:

forming on an image bearing member an electrostatic image corresponding to image information;

developing the electrostatic image by the use of the developer containing the toner for developing an electrostatic image according to claim 1, to form a developer image;

transferring the developer image to a transfer member;

transferring to a sheetlike transfer medium the developer image transferred to the transfer member; and thereafter fixing the developer image to the transfer medium.

7. An image forming method comprising:

preparing a constituted sample comprising a binder resin and a charge control resin, evaluating a relationship between the hardness of the binder resin and that of the charge control resin by measurement by a force modulation mode and a tapping mode as a viscoelasticity evaluating mode of a scanning probe microscope with respect to the binder resin and the charge control resin which are present in the particle interiors or particle surfaces of the sample, wherein in the force of modulation mode of the viscoelasticity evaluating mode of the scanning probe microscope (a) an amplitude of probe vibration of the charge control resin region is greater than amplitude of probe vibration of the binder resin region; and (b) a difference between the value of the amplitude of probe vibration in the charge control resin region and of the amplitude of probe vibration in the binder resin region is 50 m V or more;

and in a tapping mode of the viscosity evaluating mode of the scanning probe microscope where probe vibration produces a delay of phases between applied signals and response signals, a difference in phases in the charge control resin region is smaller than a difference in phases in the binder resin region, selecting the binder resin and the charge control resin wherein the hardness at 70° C. of the charge control resin is the same as or harder than the hardness of the binder resin, preparing a toner for developing an electrostatic image by mixing the binder resin and the charge control resin, and the colorant, forming on an image bearing member an electrostatic image corresponding to image information;

developing the electrostatic image by the use of the developer containing the toner for developing an electrostatic image to form a developer image;

transferring the developer image to a transfer member;

transferring to a sheetlike transfer medium the developer image transferred to the transfer member; and thereafter fixing the developer image to the transfer medium.

* * * * *